US007259645B2

(12) United States Patent
Lee

(10) Patent No.: US 7,259,645 B2
(45) Date of Patent: Aug. 21, 2007

(54) VEHICLE CONTROL SWITCH SYSTEM USING JOG SHUTTLE

(75) Inventor: Ji Seok Lee, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 24 days.

(21) Appl. No.: 11/302,076

(22) Filed: Dec. 12, 2005

(65) Prior Publication Data

US 2007/0062790 A1 Mar. 22, 2007

(30) Foreign Application Priority Data

Sep. 20, 2005 (KR) ..... 10-2005-0087317

(51) Int. Cl.
*H01H 67/00* (2006.01)

(52) U.S. Cl. ..... 335/106; 335/107; 335/122; 335/186; 200/4; 200/6 A; 200/11 J; 200/18

(58) Field of Classification Search ..... 200/4, 200/5 R, 6 A, 6 R, 11 J, 11 R, 13, 14, 16 R, 200/16 C, 16 D, 336, 564–572; 345/184; 335/106, 107, 122, 125, 126, 186, 190, 191
See application file for complete search history.

(56) References Cited

U.S. PATENT DOCUMENTS 5,939,684 A * 8/1999 Sin ..... 200/18

* cited by examiner

*Primary Examiner*—Ramon M. Barrera
(74) *Attorney, Agent, or Firm*—Morgan Lewis & Bockius LLP

(57) ABSTRACT

Disclosed is a control switch system for a vehicle, using a jog shuttle, by which a driver can rapidly and correctly select and control operation of a sound system in the vehicle even during driving of the vehicle. Since the control switch system uses simple members such as springs and metal balls, the cost of the vehicle decreases.

6 Claims, 5 Drawing Sheets

–PRIOR ART–

VEHICLE CONTROL SWITCH SYSTEM USING JOG SHUTTLE

CROSS-REFERENCE TO RELATED APPLICATION

This application claims priority to and the benefit of Korean Patent Application 10-2005-0087317 filed in the Korean Intellectual Property Office on Sep. 20, 2005, the entire content of which is incorporated herein by reference.

BACKGROUND OF THE INVENTION

1. Field of the Invention

The present invention relates to a jog shuttle, and more particularly to a control switch system for a vehicle, using a jog shuttle, by which a driver can rapidly and correctly select and control operation of a sound system in the vehicle even during driving of the vehicle.

2. Description of the Related Art

In general, a vehicle includes electronic apparatuses such as a radio set, a CD player, and a TV, and a switching system in which several switches are provided in a center fascia on the front of a driver's seat to easily manipulate functions of the electronic apparatuses. As shown in FIG. 1, a conventional navigation control key switching system 1 includes a plurality of switches 2 selectively manipulated by a driver or a passenger. By the switching system 1, it is possible to select an operation mode of a radio set, a CD player, or a TV and then operate necessary functions in the selected operation.

However, since the conventional navigation control key switching system needs a plurality of switches according the number of the functions and the switches for manipulating the functions constitute separate structures, it needs excessively many parts. Further, the conventional navigation control key switching system requires a wide installation space, looks excessively complicated, and is difficult to manipulate.

Attempts have been made to simplify switching systems using a rotating a jog shuttle. While initially such technology could be used only in general electronic appliances and cannot be used in vehicles later developments applied the technology to vehicles. However, such attempts have required motors and encoders. Since the encoder and the motor are expensive, the cost of the vehicle increases.

SUMMARY OF THE INVENTION

Embodiments of the present invention provide a control switch system for a vehicle, using a jog shuttle, by which a driver can rapidly and correctly select and control operation of a sound system in the vehicle even during driving of the vehicle.

In an exemplary embodiment there is provided a control switch system for a vehicle, using a jog shuttle, the control switch system comprising: a solenoid extended or contracted by a control signal inputted from the exterior; a switch body moved by extending or contracting the solenoid; a plurality of selection contacts installed at the periphery of the switch body; a rotation switch having a circular shape, the rotation switch being connected to the switch body by a rotational shaft and rotated by the manipulation of a user; first and second guide recesses formed symmetrically on the inner side of the switch body so as to have arc shapes; first and second springs located on the inner side of the first and second guide recesses to apply resilient forces; a switch rod having an end connected to the rotational shaft of the rotation switch and the other end making contact with the selection contacts; and a restoring spring applying a tensile force when the solenoid is extended.

The first and second balls may be installed at ends of the first and second guide recesses at which the first and second springs face each other. A stopper may be located between the first and second balls. The stopper may be moved in connection with the switch rod. The resilient forces of the first and second springs may be of the same magnitude.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, exemplary embodiments of the present invention will be described with reference to the accompanying drawings.

Figure 1:
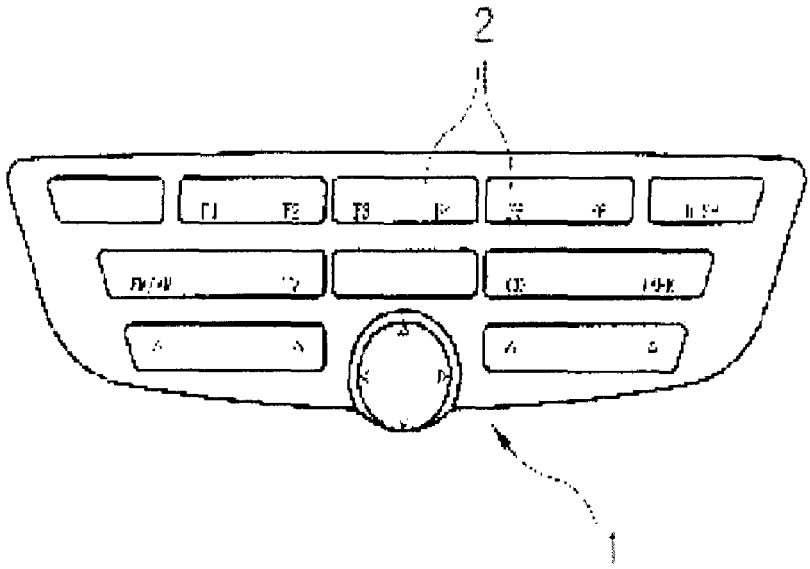
FIG. 1 is a conventional vehicular navigation control key switching system.
Figure 2:
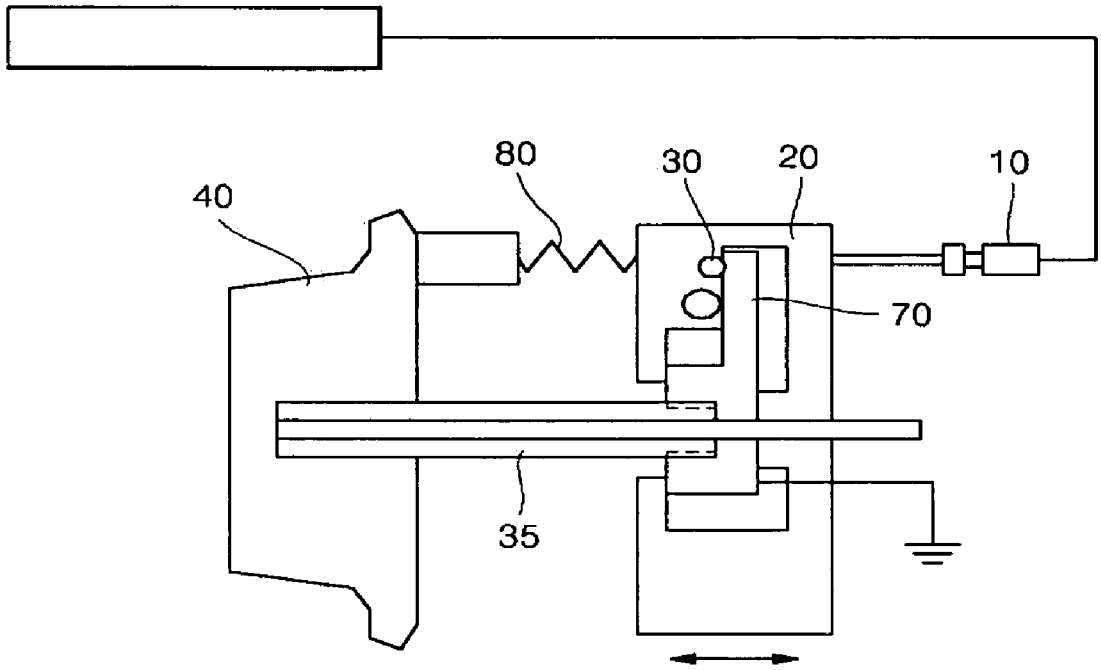
FIG. 2 is a cross-sectional view for showing a control switch system for a vehicle according to a preferred embodiment of the present invention.
Figure 3:
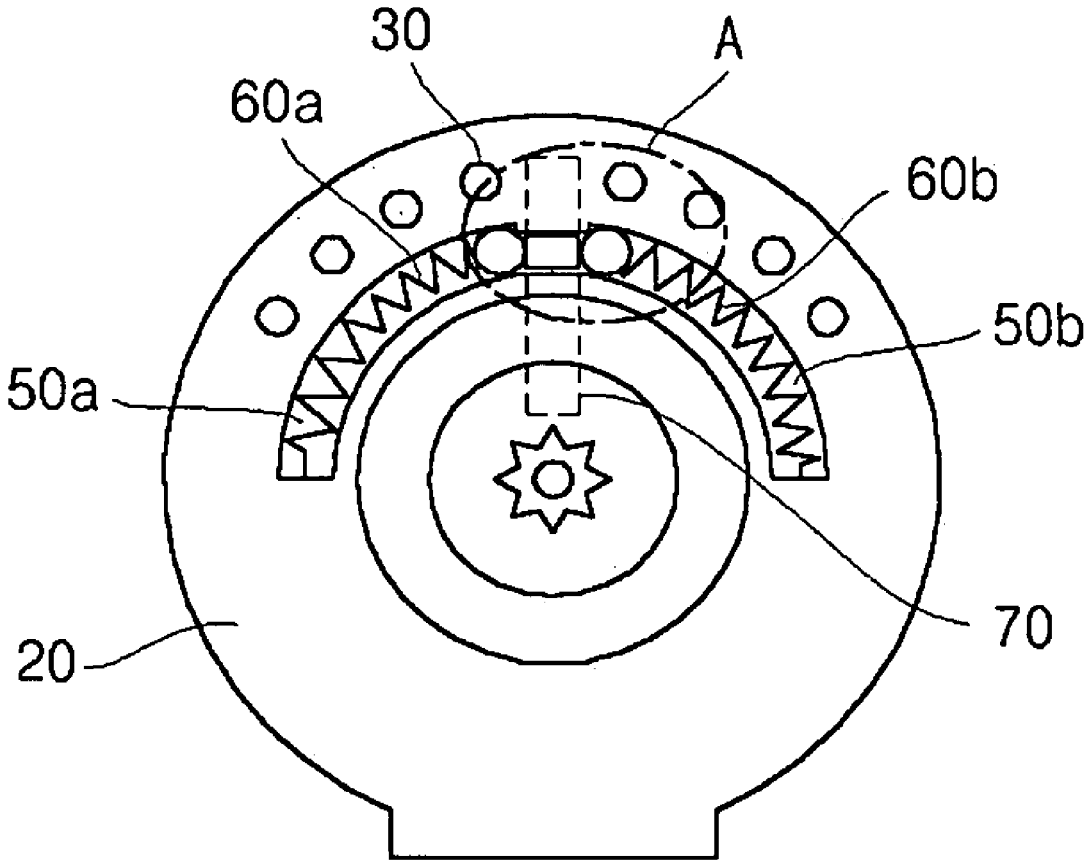
FIG. 3 is a front view of FIG. 2.
Figure 4:
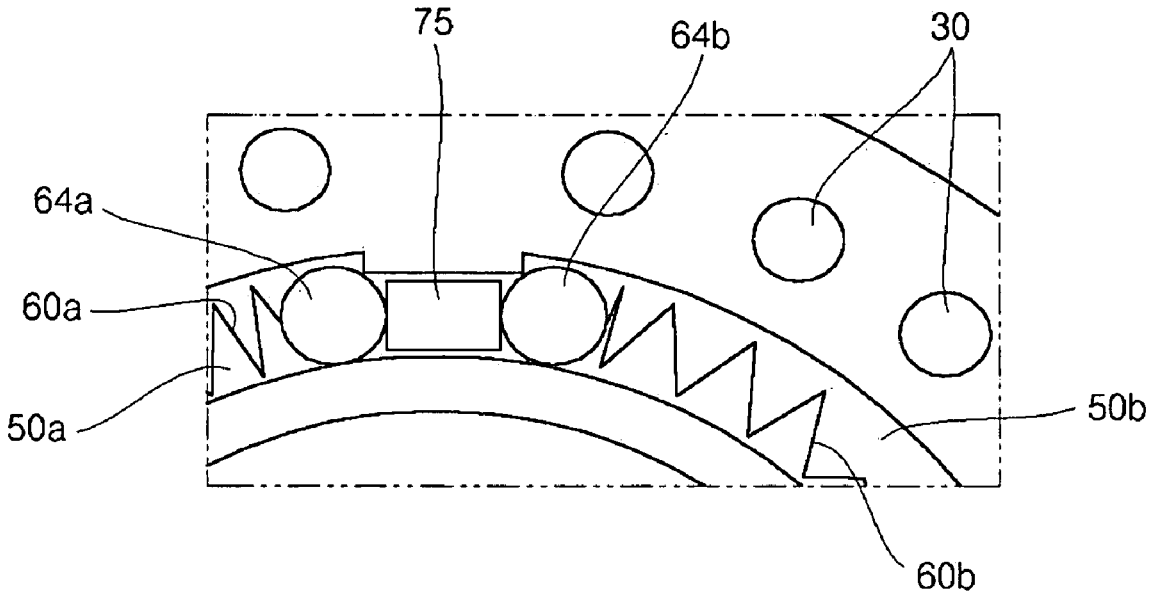
FIG. 4 is an enlarged view for showing portion A of FIG. 3.

The present invention is used to easily select and manipulate functions when a driver views information displayed by a device such as a CD player while driving a car. Referring first to FIG. 2, if the operation of a device such as a CD player is started, images are projected through a screen and a control signal is inputted to a solenoid 10 to extend or retract the solenoid 10 and thus pull a switch body 20. The function and structure of the image, screen, and filter arrangement, which displays images or implements the audio of a CD or MP3 player, are the same as those commonly used in the art; therefore a detailed description is not deemed necessary. When the switch of embodiments of the present invention is manipulated, images are projected through a display, sounds are outputted through a speaker, and, simultaneously, a control signal is inputted to solenoid 10 such that the length of solenoid 10 is reduced to pull the switch body 20. If the switch body 20 is pulled, a selection contact 30 and a switch rod 70, which are in the switch body 20, are contacted to each other. Reference numeral 80 denotes a restoration spring that restores the switch body to its original position.

Then, a user manipulates a required function by manipulating a rotation switch 40. In other words, if the rotation switch 40 is rotated to the right or left by the manipulation of the user, the switch rod 70 is rotated in the switch body 20 in the same direction of the rotation switch 40, by the rotational shaft connected to the center of the rotation switch 40. While the switch rod 70 is rotating, the end of the switch rod 70 makes contact with the selection contact 30.

Since operations such as radio function and volume control are determined by the voltage of the output signal, only one signal wire is needed. That is, each signal corresponds to a predetermined voltage range. If resistors 4, 3, 2, 1 are selected, a Fast Rewind operation is performed; if resistors 5, 6, 7, 8 are selected, a Fast Forward operation is performed. The speed of the rewind becomes gradually faster from resistor 4 to resistor 1 and the speed of the Forward becomes gradually faster from resistor 5 to resistor 8.

Figure 5:
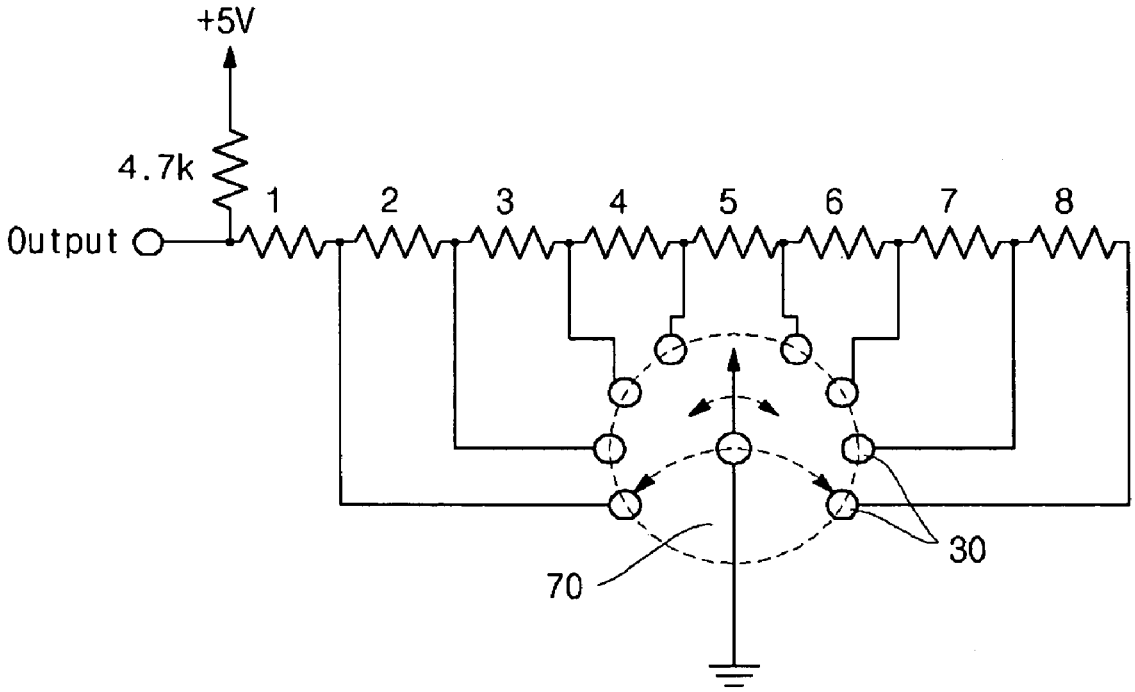
FIG. 5 is a circuitous view for showing the wiring of selection contacts used in the present invention.

Then, as shown in FIG. 5, the selection contacts 30 are connected to connecting points of resistances disposed in series. Therefore, the resistance values measured at the selection contacts 30 are different from one another. Since the power source outputted to the exterior through the selection contact 30 making contact with the switch rod 70 has a voltage value varied according to the different resistance values, the CD player performs the FF (Fast Forward) or FE (Fast Rewind) operation according to the voltage values of the signals outputted through the selection contacts 30.

Further, since an operation such as the selection by the user of audio or radio functions and the regulation of the volume is determined by using the voltage values of the outputted signals, output wires for using the signals outputted at the selection contacts are not needed. When the switch rod 70 is rotated, the stopper 75, connected to the switch rod 70, is rotated in the same direction in connection with the switch rod 70 to push one of the first and second balls 64*a* and 64*b*, thereby moving the pushed ball along the first or second guide recesses 50*a* or 50*b*.

If the user removes the force applied to the rotation switch 40 after the operation of the rotation switch is stopped by the user, the stopper 75 is pushed by the first and second springs 60*a* and 60*b* located on both side of the stopper 75 to apply resilient forces and then is returned to the original position. The rotation switch 40 may be attached to a spoke portion of a steering wheel to allow easy manipulation of the rotation switch 40.

Hereinafter, operation of a switch according to an embodiment of the present invention will be described. For an image to be displayed, a display controller operates the solenoid to allow a dial function of a control switch to be operated as a jog shuttle switch and then the switch structure of the jog shuttle switch is pushed. Here, a selection switch structure and an integration control switch, which are formed inside the switch structure of the jog shuttle switch by a gear structure centering around the rotation axis, are rotation-interworked.

When the dial is rotated, first and second balls 64*a* and 64*b* move in the direction of rotation simultaneously with selecting contact 30 so that Fast Forward or Fast Rewind occurs at a corresponding speed of the selected contact 30. When the rotation of the dial is stopped, since the first and second springs 60*a* and 60*b* restore the dial to its original position and the selection contact does not select anything, the Fast Forward or Fast Rewind is stopped. In a guide portion of the springs 60*a* and 60*b*, the stopper 75 is between the balls 64*a* and 64*b*, continuously pushed by the forces of springs 60*a* and 60*b*, thereby restoring the dial to its original position. If an image is stopped by the user, a controller stops the operation of the solenoid, switch body 20 is moved by restoration spring 80, and a gear structure deviates so that operation of the jog shuttle is stopped.

According to the present invention, in the case in which a user want to select a function of a device installed in a vehicle or to control the operation of the device, the user can select and control the function promptly while driving the vehicle. Further, since the present invention uses simple members such as springs and metal balls, the cost of the vehicle decreases.

Although preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A control switch system for a vehicle, using a jog shuttle, the control switch system comprising:

a solenoid extended or contracted by a control signal;

a switch body moved by extending or contracting the solenoid a plurality of selection contacts installed at the periphery of the switch body;

a rotation switch having a circular shape, the rotation switch being connected to the switch body by a rotational shaft and rotated by the manipulation of a user;

first and second guide recesses formed symmetrically on the inner side of the switch body so as to have arc shapes;

first and second springs located on the inner side of the first and second guide recesses to apply resilient forces;

a switch rod having an end connected to the rotational shaft of the rotation switch and the other end making contact with the selection contacts; and a restoring spring applying an tensile force when the solenoid is extended.

2. A control switch system for a vehicle according to claim 1, wherein first and second balls are installed at ends of the first and second guide recesses where the first and second springs face each other.

3. A control switch system for a vehicle according to claim 1, wherein a stopper is moved in connection with the switch rod.

4. A control switch system for a vehicle according to claim 2, wherein a stopper is located between the first and second balls.

5. A control switch system for a vehicle according to claim 4, wherein the stopper is moved in connection with the switch rod.

6. A control switch system for a vehicle according to claim 1, wherein the first and second springs have resilient forces with a same magnitude.

* * * * *